US005478160A

United States Patent [19]

Radcliffe

[11] Patent Number: 5,478,160

[45] Date of Patent: Dec. 26, 1995

[54] MULTI-PLY PRINTER RIBBON CARTRIDGE AND METHOD

[75] Inventor: William W. Radcliffe, Pitman, N.J.

[73] Assignee: Ner Data Products, Inc., Franklinville, N.J.

[21] Appl. No.: 283,242

[22] Filed: Jul. 29, 1994

[51] Int. Cl.[6] ..... B41J 33/54

[52] U.S. Cl. ..... 400/241.1; 400/195

[58] Field of Search ..... 400/195, 196.1, 400/241, 241.1, 241.2, 241.3

[56] References Cited

U.S. PATENT DOCUMENTS

| | | | |
|---|---|---|---|
| 1,092,856 | 4/1914 | Pelton | 400/241.1 |
| 1,830,620 | 11/1931 | Pelton | 400/241.1 |
| 2,728,439 | 12/1955 | Murphy et al. | 400/241.1 |
| 3,010,559 | 11/1961 | Ploeger et al. | 400/241.1 |
| 3,022,880 | 2/1962 | Newman | 400/241.1 |
| 3,092,236 | 6/1963 | Campbell et al. | 400/241.1 |
| 3,110,386 | 11/1963 | Raines | 400/241.1 |
| 3,460,666 | 8/1969 | Ploeger, Jr. | 400/241.1 X |
| 3,650,059 | 3/1972 | Johnson | 400/134.4 |
| 3,749,222 | 7/1973 | Leach | 400/241.1 |
| 4,016,321 | 4/1977 | McIntyre, Jr. | 428/216 |
| 4,279,522 | 7/1981 | Yonker | 400/195 X |
| 4,940,820 | 7/1990 | Pithouse | 428/34.9 |

FOREIGN PATENT DOCUMENTS

| | | | |
|---|---|---|---|
| 58-220782 | 12/1983 | Japan . | |
| 0220782 | 12/1983 | Japan | 400/241.1 |
| 0014394 | 11/1990 | WIPO | 400/241.1 |

*Primary Examiner*—Christopher A. Bennett
*Attorney, Agent, or Firm*—Thomas A. Lennox

[57] ABSTRACT

A point of sale printer ink cartridge includes a mobius loop endless ribbon with at least two ply of woven twisted nylon fabric sealed along lengthwise edges with or without a third ink absorbing layer interposed between the two ply of nylon yielding synergistic ink capacity increases, long print life, long ribbon durability, and increased butt weld strength of the ends of the ribbon.

18 Claims, 1 Drawing Sheet

MULTI-PLY PRINTER RIBBON CARTRIDGE AND METHOD

BACKGROUND OF THE INVENTION

This invention involves a multi-ply ribbon ink cartridge for use in impact pin printers. More particularly the invention involves the use of this cartridge in point of sale printers.

The use of compact and larger printers to print receipts, credit card vouchers and other printed matter at point of sale locations has proliferated to a point where almost every retail outlet has a point of sale printer. For example, at supermarkets and other large retail outlets, the computer driven check out apparatus includes a dot matrix printer that can print a record receipt of the purchases as well as coupons for future purchases. At the same type of location, it is common to have a small impact printer to print a credit card voucher which shows the total purchase amount and provides for signature by the customer. This latter type of device is now commonly used in filling stations and other retail outlets to facilitate credit card purchasing. Automated bank tellers utilize a small printer to print out the receipt and the balance information on the account of the customer. These printers are commonly nine pin, impact dot matrix printers that have a speed less than about 200 characters per second. Some printers are line printers wherein the pins are aligned across the length of the printing space and operate at a speed of about 120 to about 240 lines per minute. This speed is slower than most computer printers used for personal use and much slower than the commercial type printers used for professional offices and the like.

The point of sale printers, both line and serial types, utilize a replaceable printer ink cartridge to supply the ink during the printing process. While these ink cartridges vary widely in size, shape and configuration, they all include a number of common elements. The ink cartridge includes a housing with an exterior wall structure that encloses an internal chamber. First and second openings are provided through the wall structure both opening to the internal chamber. Generally these openings are on opposite ends of the internal chamber. An endless ribbon is installed in the cartridge with almost the entire length of the ribbon in the internal chamber. A short section of the ribbon trained out of the first opening and back into the internal chamber through the second opening. A guide mechanism is provided to guide the section of the ribbon on the outside of the chamber along a path from the first opening to the second opening. The cartridge is also equipped with a moving mechanism that is responsive to an external rotative force provided by the printer to pull the ribbon out of the internal chamber through the first opening along the guide mechanism and back into the second opening while pushing the ribbon back into the internal chamber. Ink is absorbed onto the endless ribbon. A visible mark on the paper results when the path of the external section of the ribbon is interposed between the paper and the pins to provide an impact on the ribbon against the paper.

The ribbons on the point of sale printer ink cartridges, as well as those for the higher speed printers, are essentially all a single ply of nylon fabric. The nylon fabric may be woven from threads that are textured, flat, twisted and the like. Nylon is the fiber of choice as the structure life of the ribbon is an important if not critical requirement of the ink cartridge. In this case the term "life" is referring to the time before the ribbon wears out and breaks causing a complete failure of the printer or frays on the surface to a degree that it interferes with the printing. It is most important that the structure life of the ribbon be longer than the life of the ink adsorbed on the ribbon.

While print quality is important in point of sale printing units, the life of the ink supply on the ribbon is even more important. Nylon, chosen for its durability, does not have a high level of ink absorption capability. In normal production operations, it is difficult to attain ink loading on the single ply of nylon fabric higher than about 20% of the weight of the ribbon. This limit places a definite life of the ink supply before the ribbon cartridge must be replaced.

It is common to observe poor print quality with extremely light printing on point of sale printers. It is so common that almost everyone has received an apology from the sales clerk as to the quality of the print out being handed to them at the check out location. From a practical stand point, the ink ribbon cartridges on point of sale printers are commonly used well beyond the recommended period of use. Some companies are offering services to regularly maintain the point of sale equipment despite the high costs of such procedures. In general, the life of the ink supply is the determining factor as to when the printer requires a change of the ribbon cartridge.

Despite the long felt need of printer ink cartridge with an extended printing life, no substantial improvements to this life have been achieved. In U.S. Pat. No. 2,728,439, a typewriter ribbon of two ply of nylon fabric is described indicating that this ribbon will last in use far longer under severe service conditions than the ribbons of the then prior art. In Japanese Application No. 57-105179 a ribbon for typewriters and printers is described constructed of two porous organic films with printing ink enclosed between the two films. Printer ribbon substrates are described in U.S. Pat. No. 4,016,321 and impression fabric made of yarn containing variable shrinkage filaments for use in an inking ribbon is described in U.S. Pat. No. 3,749,222. Despite this prior art, a great need to extend the life of the point of sale printers has not been achieved. Further, the objects described herein below have not been attained by the prior art.

SUMMARY OF INVENTION

It is an object of the invention to provide a printer ink cartridge that utilizes a ribbon and an ink supply absorbed on the ribbon for use under the conditions of point of sale printers.

It is a particular object of the invention to provide a printer ink cartridge that provides a long ink supply coupled with sufficient ribbon structural integrity to last until the ink runs out. These advantages are particularly effective where it is costly and inconvenient to make frequent printer ink cartridge changes, such as remote bank ATM terminals, point of sale terminals, mobile delivery printers, and the like.

It is a specific object of the present invention to provide a printer ink cartridge with a ribbon that not only has extended printing life, but with an improved surface durability of the ribbon.

It is a further object of the present invention to provide a printer ink cartridge that provides an extended printing life as measured by a print contrast signal, but also provides consistent printing of legible characters across the line of print. It is an object of the present invention to provide a printer ink cartridge with a two ply cloth construction that holds more ink than two separate layers of the same fabric would hold.

It is an additional object of the present invention to provide a printer ink cartridge with a continuous ribbon with substantially increased weld strength as compared to the expanded single ply nylon ribbons.

It is a further object of the present invention to provide a printer ink cartridge with the two ply construction increasing the durability of the surface of the nylon allowing the use of a mobius loop to further extend the printing life of the ribbon.

It is a further object of the present invention to provide a printer ink cartridge that, due to up to three times the print life from the same cartridge, reduces waste of materials and reduces the drain on the environment.

It is a particular object of the present invention to reduce the number of printer ink cartridge changes providing substantial time and cost saving.

An aspect of the invention is an inked endless ribbon cartridge for use in a printer that includes striking means that includes a multiplicity of pins to impact said ribbon. The cartridge includes a housing that includes exterior wall means enclosing an internal chamber, and first and second openings through the exterior wall means both opening to the internal chamber. The endless ribbon includes a major length in the internal chamber and a section trained out of the first opening and back into the internal chamber through the second opening. The endless ribbon further includes two plies of woven fabric and sealing means along lengthwise edges of the ribbon to connect the lengthwise edges together. The cartridge further includes guide means to guide the section of the ribbon along a path outside the housing from the first opening to the second opening. The cartridge also includes moving means responsive to external rotative force to pull the ribbon out of the internal chamber through the first opening, along the guide means, and into the second opening and push the ribbon into the internal chamber. The cartridge further includes ink means adsorbed onto the ribbon capable of providing a visible mark on paper when the ribbon is interposed between the paper and the striking means to receive an impact on the ribbon. The ink means is of a formulation to avoid any significant wear on said pins.

It is preferred that the fabric include nylon fibers and more preferred that the fabric consist of nylon fibers. It is also preferred that the ribbon include three plies that include two outer fabric plies consisting of nylon fiber and a third ply interposed between the outer plies, the third ply including a fibrous material having a higher capacity to absorb the ink means than the outer plies. It is more preferred that the third ply be a non woven mat. It is also preferred that the third ply be a woven silk fabric. It is also preferred that a quantity of the ink means adsorbed on the ribbon be greater than two times a maximum quantity of ink means adsorbable on a single ply of the fabric and more preferred that the quantity of the ink means adsorbed on the ribbon be at least two and half times the maximum quantity of ink means adsorbable on a single ply of the fabric. It is also preferred that the ink means include oil soluble dyes and no substantial or significant particulate.

Another aspect of the invention is a method of printing that includes providing printing means that prints indicia on a continuous length of paper, wherein the printing means includes a multiplicity of pins and means to cause the pins to strike the paper in a selective pattern to print said indicia. The method further includes providing an inked endless ribbon cartridge for use in the printing means. The cartridge includes a housing that includes exterior wall means enclosing an internal chamber and first and second openings through the exterior wall means both opening to the internal chamber. The cartridge further includes an endless ribbon that includes a major length in the internal chamber and a section trained out of the first opening and back into internal chamber through the second opening. The cartridge further includes guide means to guide the section of the ribbon along a path outside the housing from the first opening to the second opening. The cartridge also includes moving means responsive to external rotative force to pull the ribbon out of the internal chamber through the first opening, along the guide means, and into the second opening and push the ribbon into the internal chamber. The endless ribbon includes two plies of woven fabric and sealing means along lengthwise edges of the ribbon to connect the lengthwise edges together. The cartridge further includes ink means adsorbed onto the ribbon capable of providing a visible mark on paper when the ribbon is interposed between the paper and the pins to receive an impact on the ribbon. The ink means is of a formulation to avoid any significant wear on said pins. The method further includes connecting the cartridge into the printing means positioning the ribbon between the pins and the continuous length of paper, such that when the printing means is actuated to cause the multiplicity of pins to strike the paper the ribbon will be positioned between the pins and the paper.

It is preferred that the method further include that the providing of the cartridge further includes providing fabric that includes nylon fibers. It is further preferred that the method further include that the providing of the cartridge further includes providing that the fabric consists of nylon fibers. It is also preferred that the method further include that the providing of the cartridge further includes providing that the ribbon includes three plies that includes two outer fabric plies consisting of nylon fiber and a third ply interposed between the outer plies, the third ply including a fibrous material having a higher capacity to absorb the ink means than the outer plies. It is more preferred that the method further include that the providing of the cartridge further includes that the third ply be a non woven mat. It is further preferred that the method further include that providing of the cartridge that further includes that the third ply be a woven silk fabric. It is further preferred that the method further include that the providing of the cartridge further includes providing a quantity of the ink means adsorbed on the ribbon that is greater than two times a maximum quantity of ink means adsorbable on a single ply of the fabric, and more preferred that the quantity of the ink means adsorbed on the ribbon is at least two and half times the maximum quantity of ink means adsorbable on a single ply of the fabric. It is further preferred that the method further include that the providing of the cartridge further includes providing that the ink means includes oil soluble dyes and no significant particulate.

DESCRIPTION OF PREFERRED EMBODIMENTS

Figure 3:
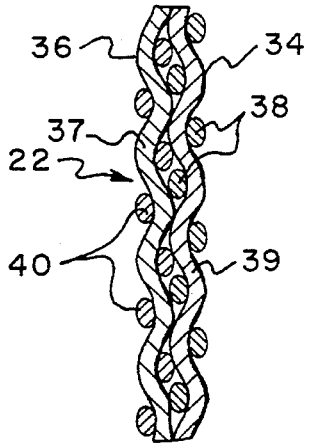
FIG. 3 is a cross-sectional view taken along lines 3—3 of FIG. 1.
Figure 2:
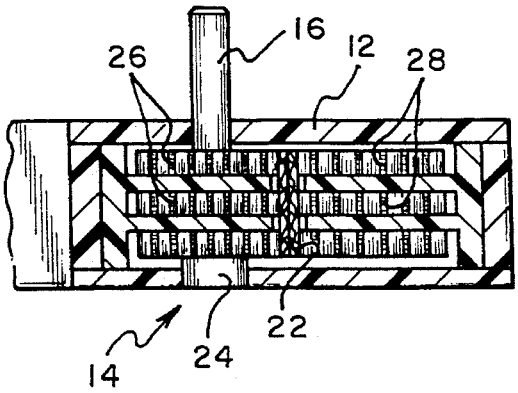
FIG. 2 is a partially cut-away cross sectional view taken along lines 2—2 of FIG. 1.
Figure 4:
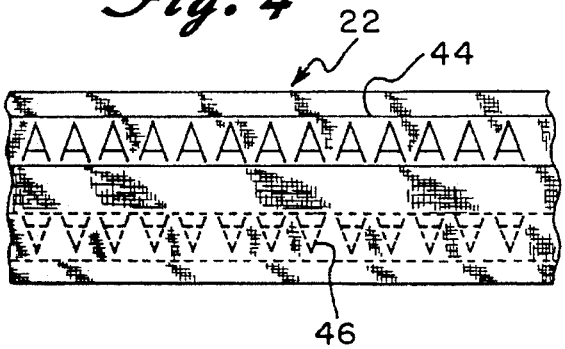
FIG. 4 is a cut-away view of a ribbon diagram similar to that shown in FIGS. 1 and 3.

Printer ink cartridge 10 is illustrated in FIGS. 1 through 4. Cartridge 10 includes housing 12 having exterior walls that enclose an internal chamber storing the endless length of ribbon 22. External drive post 16 extends upwardly from the upper wall of housing 12 and is part of drive mechanism 14 illustrated in FIG. 2. Opening 20, hidden in this view, is a slot from which endless ribbon 22 trains around the exit guide 17 across a span to return guide 15 and back into housing 12 through return opening slot 18. Guides 15 and 17 hold a section of ribbon 22 in an exterior position from housing 12 providing opening 19 within which the pin striking mechanism of the printer extends to strike inside fabric surface 34 transferring ink through outside fabric surface 36 to the paper. In mechanism 14, post 16 terminates at base section 24 and rotates freely within housing 12. Horizontal gear members 26 are horizontally and radially fixed to post 16 such that when post 16 is rotated by the printer mechanism, the outer edges of gears 16 engage ribbon 22 sandwiched between the enmeshed teeth of gear members 28 which rotate freely on a shaft not illustrated. Ribbon 22 is pulled by drive mechanism 14 and packed into the internal chamber of housing 12. Two-ply ribbon 22 is constructed of two plies of twisted nylon fabric heat sealed lengthwise along upper edge 30 and lower edge 32. Outer ply 36 is constructed of lengthwise yarn 34 and crosswise yarn 37 while inner ply 34 is constructed of crosswise yarn 39 and lengthwise yarn 38. As illustrated in FIG. 3, spaces are formed within the fabric construction to hold ink. Ribbon 22 is a mobius loop such that it is twisted one hundred and eighty degrees before the ends are attached to form the endless loop. As shown in FIG. 4, the outer surface of inner ply 34 shows a line of printed characters along path 44 where the pins have struck on that side. On the opposite surface, that being outer ply 36 of ribbon 22 a previous path 46, shown dashed, along the ribbon illustrates where the strikes have been made on the opposite surface. Thus, as the mobius loop travels through its track, first one side is struck along the top edge by the pins while on the next pass past a given section of the ribbon the path is at the top of the opposite surface. Since the paths do not overlap the use of the mobius loop substantially increases the service life of the ribbon.

Figure 5:
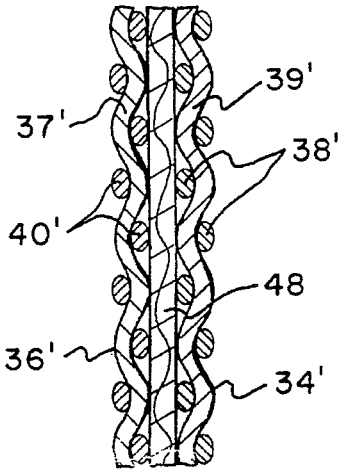
FIG. 5 is a cross-sectional view similar to that of FIG. 3 of a second embodiment of the invention.

In FIG. 5 an alternative embodiment is illustrated wherein a third ply is sandwiched between outer ply 36' and inner ply 34'. The outside plies are essentially identical to that illustrated in FIG. 3. Inside ply 48 is an unwoven fabric or woven fabric that absorbs ink. Nylon fabric only allows ink to be adsorbed on the outer surface of the fibers, natural fibers such as cotton or silk absorb ink and provide a substantial increased ink loading capacity. As an example, two mil silk ply 48 provides a substantial increased ink loading capacity even above that of ribbon 22 with increased print life.

To demonstrate the present invention, a standard single ply printer ink cartridge was produced using standard methods. The ribbons vary from 4 mil and 5 mil twisted and 4 mil and 5 mil flat woven nylon ribbon. With one or two passes through a standard inking machine, the average weight percent of ink adsorbed onto a standard single ply ribbon is in the 20% to 21% range.

Figure 1:
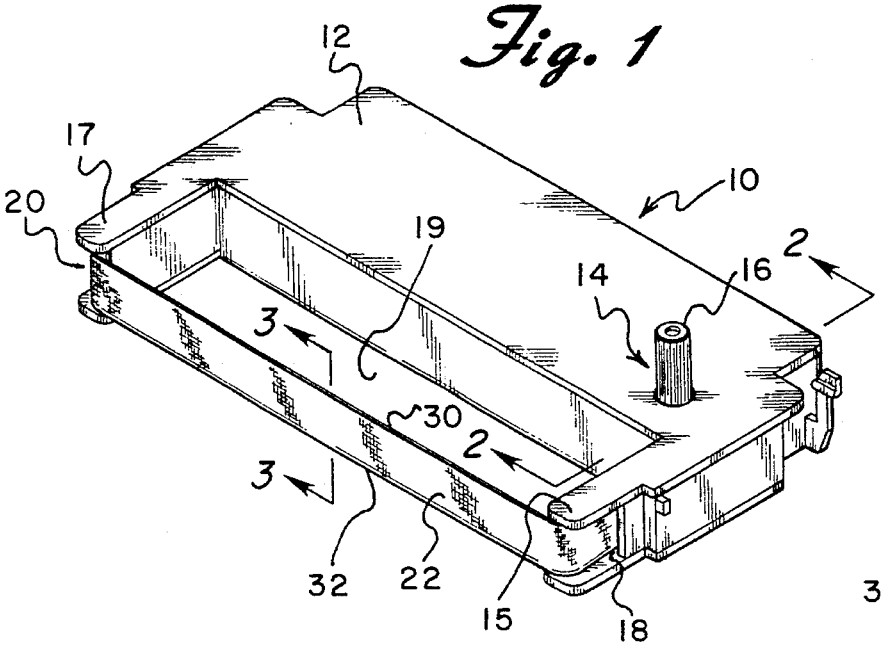
FIG. 1 is a perspective view of an ink printer cartridge of the present invention.

Two-ply nylon tapes are inked using standard procedures utilizing two passes of the nylon ribbon through an inking machine in cartridges similar to that shown in FIG. 1. The results obtained are listed in Table 1.

TABLE I

INK ABSORPTION ON TWO PLY TAPES OF THIS INVENTION

| Nylon/ink | Av. ink % | Range % |
|---|---|---|
| 4 mil twist/purple | 26.0 | 25.4–26.8 |
| 5 mil twist/purple | 25.6 | 25.1–25.8 |
| 4 mil flat/purple | 24.1 | 23.2–25.8 |
| 5 mil flat/purple | 23.8 | 23.4–24.3 |
| 4 mil twist/black | 27.0 | 25.9–28.4 |
| 5 mil twist/black | 25.6 | 24.6–26.2 |
| 4 mil flat/black | 24.9 | 23.2–27.2 |
| 5 mil flat/black | 24.0 | 23.4–24.5 |
| 4 mil twist red | 25.6 | 25.5–25.9 |
| 5 mil twist red | 22.7 | 22.5–22.9 |
| 4 mil flat red | 25.4 | 24.8–26.8 |

These results demonstrate a synergistic effect of ink absorption. For example, if a one ply ribbon adsorbs about 20% by weight of the ink, that indicates that about 20 grams are adsorbed on about 100 grams of the one ply tape. It would be expected that two ply would adsorb about another 20 grams for a total of 40 grams per 200 grams of tape. In fact, it would be expected that adsorption of the lengthwise joined edge areas would be reduced so that the adsorption rate for the two-ply tape would be less. However, as illustrated in the results of Table 1, it is possible using this invention to load the two ply ribbon with about 27% of its weight or about 54 grams for 200 grams of the two ply nylon ribbon. To state it another way, the amount of ink in the two ply nylon ribbon of the present invention is about 270% that of the one ply for the same length. It is observed that the twisted two ply nylon ribbon shows less surface ink as compared to the flat style of fabric.

The following procedures demonstrate increased printing performance life of the printer ink cartridge of the present invention. Typical point of sale printing is performed on the IBM 4683 Model 2, the NCR 7053 and the Epson ERC-23 model printers. The IBM and NCR printers represent the type used in large chain stores and many grocery stores. The Epson printer represents the style of printer popular in credit card processing applications. Two-ply ribbon cartridges similar to cartridge 10 utilizing three mil texturized nylon fabric, four mil flat and twisted nylon fabric, and five mil flat and twisted nylon fabric all perform satisfactorily in the present invention. Both the four ply and the five mil fabrics are about 280 thread count. The four mil two-ply twisted yarn fabric ribbons yield the best results and the following tests utilize that form. In some cases, a short length ribbon is utilized for comparison of the print life with the results extrapolated to full length products. The demonstration of the printing life tests are provided in Tables II, through V.

The IBM 4683 cartridge accommodates about 55 feet of either one half inch wide four mil twisted two-ply nylon ribbon or the standard single ply ribbon. The four mil twisted two-ply ribbon gives the best results as measured by ribbon character printing life that is about three times the printing life of a single ply ribbon cartridge. The ribbon character printing life is measured by the print contrast signal as tested using Moore Kidder Optical Character Test Model 082. In that test, a print contrast signal below about 0.2 is generally considered unsatisfactory. A signal below about 0.3 is beginning to get difficult to read and a signal below 0.2 requires excellent lighting conditions and good eye sight to read. As shown in Table II, a standard single ply ribbon cartridge with purple ink reaches the level of 0.2 after about 6 million characters are printed. With the two-ply ribbon cartridge of the present invention, the print contrast signal is still above 0.2 after 18 million characters are printed. This cartridge uses a mobius loop for both the single and two-ply ribbons.

TABLE II

IBM 4683 TWO-PLY PURPLE RIBBON TEST

| NO. OF CHARACTERS | PRINT CONTRAST SIGNAL | |
|---|---|---|
| (MILLIONS) | Standard 1-Ply | New 2-Ply |
| 0 | 0.71 | 0.84 |
| 2 | 0.47 | 0.71 |
| 4 | 0.38 | 0.62 |
| 6 | 0.21 | 0.54 |
| 8 | | 0.43 |
| 10 | | 0.38 |
| 12 | | 0.40 |
| 14 | | 0.29 |
| 16 | | 0.27 |
| 18 | | 0.22 |
| 20 | | 0.19 |
| 22 | | 0.17 |

The NCR 7053 cartridge, accommodates a maximum of about 56 feet of two-ply four mil twisted nylon ribbon and about 50 feet of the two-ply five mil nylon ribbon. The two-ply cartridge is made with a mobiles loop. In this test printing of the entire alphabet is repeated to provide a realistic demonstration of printing life of the ribbons. As shown in Table III, the standard single ply ribbon, being about 63 feet long, reaches a print contrast signal of 0.2 after 15 million characters while the 56 foot long two-ply ribbon maintains a 0.2 signal past 45 million characters. Also of importance is that the single ply tape demonstrates poor character definition such that portions of each letter or number fades away making it difficult to read at the 10 million mark. With the two-ply ribbon of the present invention, all the characters are fully defined at 30 million using the purple ink. Black ink does not perform as well as the purple ink, but still has excellent character definition at 18 million characters and maintains a print contrast single of about 0.2 past 33 million characters.

TABLE III

NCR 7053 2-PLY PURPLE RIBBON TEST

| NO. OF CHARACTERS | PRINT CONTRAST SIGNAL | |
|---|---|---|
| (MILLIONS) | Standard 1-Ply | New 2-Ply |
| 0 | 0.76 | 0.81 |
| 5 | 0.35 | 0.63 |
| 10 | 0.27 | 0.62 |
| 15 | 0.20 | 0.62 |
| 20 | | 0.33 |
| 25 | | 0.27 |
| 30 | | 0.25 |
| 35 | | 0.19 |
| 40 | | 0.19 |
| 45 | | 0.22 |
| 50 | | 0.19 |

In the Epson ERC-23 printer a full length of ribbon is installed due to the small size of the cartridge. A cartridge is able to accommodate about 10 feet of the two ply 4 mil twisted nylon ribbon of the present invention. The single ply five mil flat ribbon is about 14 feet long. As shown in Table V, with purple ink, the two ply ribbon cartridge provides about two and a half times the printer life of the single ply unit. The print quality of the single ply cartridge also becomes inconsistent at about 800,000 characters while with the cartridge of the present invention, the print quality is excellent at 3 million characters and above. A test demonstration is shown in Table V with black ink. Particularly with the black ink in the present invention the quality of the characters across the line of the page is consistent to three and half million characters and above. With the standard single ply cartridge, sections of the line are almost faded out at less then 1 million characters and major portions of the lines virtually disappear at one and a half million characters. The initial print quality of the ink cartridges of the present invention provides print which is more intense with greater ink disposition as well as slightly wider characters. The wider appearance tends to disappear after a few thousand character prints and thereafter, the quality of the characters is substantially superior of the single ply ribbon. Although purple and red bichrome inks do not provide as great an improvement over the standard single ply ribbon products, two ply cartridges in each color yields about 1½ times the number of characters of the standard products.

TABLE IV

ERC-23 PURPLE TWO-PLY RIBBON TEST

| No. of Characters | Print Contrast Signal | |
|---|---|---|
| (Millions) | Standard 1-Ply | New 2 Ply |
| 0.0 | 0.78 | 0.83 |
| 0.4 | 0.55 | 0.72 |
| 0.8 | 0.55 | 0.63 |
| 1.2 | 0.43 | 0.54 |
| 1.6 | 0.39 | 0.45 |
| 2.0 | | 0.40 |
| 2.4 | | 0.39 |
| 2.8 | | 0.41 |
| 3.2 | | 0.39 |
| 3.6 | | 0.33 |
| 4.0 | | 0.28 |
| 4.2 | | 0.30 |

TABLE V

EPSON ERC-23 BLACK 2-PLY RIBBON TEST

| NO. OF CHARACTERS | PRINT CONTRAST SIGNAL | |
|---|---|---|
| (MILLIONS) | Standard 1-Ply | New 2-Ply |
| 0.0 | 0.83 | 0.84 |
| 0.4 | 0.56 | 0.63 |
| 0.8 | 0.53 | 0.55 |
| 1.2 | 0.44 | 0.42 |
| 1.6 | 0.27 | 0.39 |
| 2.0 | | 0.40 |
| 2.4 | | 0.34 |
| 2.8 | | 0.30 |
| 3.2 | | 0.30 |
| 3.8 | | 0.29 |

Although it would be expected that the two ply ribbon would have greater tensile strength, it does not necessary follow that the strength of the joint weld to form the continuous ribbon would have anything but equal strength. Since the joint is a heat weld of the ends of the ribbon, it was expected that the weld strength of the joint might be about equal or only slightly above the weld strength of the single ply ribbon. The tensile strength of the welded joint for the two ply ribbon is at least one and a half times that of the single ply ribbon thus insuring that the structure life of the ribbon loop will be greater then the printing life of the ribbon.

The use of a two-ply ribbon in a typewriter performs to different criteria than in dot matrix printers. The use of the two-ply ribbon of the present invention yields substantially different results with different criteria. The nine pin dot matrix printer or the line printer, such as the Epson printer described above, utilizes pins that are about three time the size of a human hair hammering against the ribbon millions of times. This is an entirely different type of criteria than required for a typewriter wherein the entire character is printed with one stroke. The nylon filaments do not absorb the ink but rather the ink is entrained on the surface and in the crevices between the fabric fibers. As would be expected, high loading of ink on the typewriter ribbon causes the cavities within the characters to quickly clog up. Further the typewriter inks are based on pigments such as carbon black. Impact pin printer inks are commonly dye based inks without particulate.

Another characteristic of the life of the ribbon is the surface of the nylon ribbon after millions of hammered characters. With the single ply cartridge the deterioration of the surface of the ribbon toward the end of the printing life of the ink supply is only a slight problem. However, if the printing were to be doubled for the single ply ribbon, the surface of the ribbon would deteriorate, fray and cause poor print quality as well as ribbon breakage. With the two-ply ribbon of the present invention, the surface quality of the ribbon even after tens of millions of characters is still quite satisfactory. A cushioning effect is attained with present construction.

Testing of the printing cartridges of the present invention on higher speed printer yields poorer results. The advantages of the present inventions are not realized on these higher speed printers. The present invention is particularly effective on printers with speeds in the range of about 50 to 80 characters per second and up to about 120 lines per minute for the line printers. The advantages of the increased print and performance life of the printer cartridges of the present invention increases the actual field use up to a number of months in many applications. This is a substantial and huge advantage to the end user in the reduction of service calls and service to the printers.

In point of sale printing application, two important characteristics of the printer ink cartridge are present. The first and most important is the life of the cartridge. This life includes the structural life of the ribbon before breakage and the printing life of the ink on the ribbon. The structural life of the ribbon must be substantially longer than printing life of the ribbon to avoid the possibility of damaging the printer. The weld strength of the two-ply ribbon is over one and one-half times that of the single ply ribbon thus essentially assuring that the ribbon will not break during use. The print quality is important as the printed product must be legible. However, the high print quality of the printers for desk top printing and the like is not required for these applications. However, what is most important is that the print be legible for as long a period of time in the use of the cartridge as possible. In this invention, the print quality is more then adequate and is of the highest quality particularly after long use of the ribbon. In addition, the surface of the ribbon of the two-ply structure is more durable then that of the single ply causing much less deterioration of the fabric over the use of the ribbon allowing up to three times the number of character impacts and three times the life of the cartridge. Most importantly, despite the higher ink capacity of the two-ply ribbon cartridge, performance on the point of sale printers shows little ink spotting or splattering, even during the early use of the ribbon. It is clear from the performance of the two-ply ribbons of the present invention that the ink is flowing through the ribbon fabric more efficiently then is achieved with a single ply ribbon. The higher ink loading is achieved without the deposit of excess surface ink on the outside surfaces of the ribbon. In the three-ply versions of the present invention, it is possible to create a reservoir of ink between the two-ply absorbed or absorbed on woven fabrics and non woven fabrics that will allow the higher ink content to be held. The outside layers of the nylon fabric protect the inner reservoir fabric from deterioration while allowing the ink to flow from the reservoir through the nylon fabric to the surface of the ribbon. The inclusion of two mil silk fabric between two layers of 4 mil nylon fabric provides a substantial increase in the ink carrying capacity a substantial increase in the length of the printing life of the ribbon, well above the two-ply nylon ribbons of the present invention.

While this invention has been described with reference to specific embodiments disclosed herein, it is not confined to the details set forth and the patent is intended to include modifications and changes which may come within and extend from the following claims.

I claim:

1. An inked endless ribbon cartridge for use in a printer comprising striking means comprising a multiplicity of pins to impact said ribbon, the cartridge comprising:

(a) a housing comprising:

(i) exterior wall means enclosing an internal chamber, and (ii) first and second openings through the exterior wall means both opening to the internal chamber, (b) said endless ribbon comprising a major length in the internal chamber and a section trained out of the first opening and back into the internal chamber through the second opening, wherein the endless ribbon comprises two plies of woven fabric and sealing means along lengthwise edges of the ribbon to connect the lengthwise edges together, (c) guide means to guide the section of the ribbon along a path outside the housing from the first opening to the second opening, (d) moving means responsive to external rotative force to pull the ribbon out of the internal chamber through the first opening, along the guide means, and into the second opening and push the ribbon into the internal chamber, and (e) ink means adsorbed onto the ribbon capable of providing a visible mark on paper when the ribbon is interposed between the paper and the striking means to receive an impact on the ribbon, wherein the ink means is of a formulation to avoid any significant wear on said pins.

2. The cartridge of claim 1 wherein the fabric comprises nylon fibers.

3. The cartridge of claim 2 wherein the fabric consists of nylon fibers.

4. The cartridge of claim 1 wherein the ribbon comprises three plies comprising two outer fabric plies consisting of nylon fiber and a third ply interposed between the outer plies, the third ply comprising a fibrous material having a higher capacity to absorb the ink means than the outer plies.

5. The cartridge of claim 4 wherein the third ply is a non woven mat.

6. The cartridge of claim 4 wherein the third ply is a woven silk fabric.

7. The cartridge of claim 1 wherein a quantity of the ink means adsorbed on the ribbon is greater than two times a maximum quantity of ink means adsorbable on a single ply of the fabric.

8. The cartridge of claim 7 wherein the quantity of the ink means adsorbed on the ribbon is at least two and half times the maximum quantity of ink means adsorbable on a single ply of the fabric.

9. The cartridge of claim 1 wherein the ink means comprises oil soluble dyes and no significant particulate.

10. A method of printing comprising:

(A) providing printing means that prints indicia on a continuous length of paper, wherein the printing means comprises a multiplicity of pins and means to cause the pins to strike the paper in a selective pattern to print said indicia, (B) providing an inked endless ribbon cartridge for use in the printing means, the cartridge comprising:

(i) a housing comprising:

(a) exterior wall means enclosing an internal chamber, and (b) first and second openings through the exterior wall means both opening to the internal chamber, (ii) an endless ribbon comprising a major length in the internal chamber and a section trained out of the first opening and back into internal chamber through the second opening, (iii) guide means to guide the section of the ribbon along a path outside the housing from the first opening to the second opening, and (iv) moving means responsive to external rotative force to pull the ribbon out of the internal chamber through the first opening, along the guide means, and into the second opening and push the ribbon into the internal chamber, wherein the endless ribbon comprises two plies of woven fabric and sealing means along lengthwise edges of the ribbon to connect the lengthwise edges together, (v) ink means adsorbed onto the ribbon capable of providing a visible mark on paper when the ribbon is interposed between the paper and the pins to receive an impact on the ribbon, wherein the ink means is of a formulation to avoid any significant wear on said pins, and (C) connecting the cartridge into the printing means positioning the ribbon between the pins and the continuous length of paper, such that when the printing means is actuated to cause the multiplicity of pins to strike the paper the ribbon will be positioned between the pins and the paper.

11. The method of claim 10 wherein the providing of the cartridge further comprises providing fabric that comprises nylon fibers.

12. The method of claim 11 wherein the providing of the cartridge further comprises providing that the fabric consists of nylon fibers.

13. The method of claim 10 wherein the providing of the cartridge further comprises providing that the ribbon comprises three plies comprising two outer fabric plies consisting of nylon fiber and a third ply interposed between the outer plies, the third ply comprising a fibrous material having a higher capacity to absorb the ink means than the outer plies.

14. The method of claim 13 wherein the providing of the cartridge further comprises that the third ply is a non woven mat.

15. The method of claim 13 wherein the providing of the cartridge further comprises that the third ply is a woven silk fabric.

16. The method of claim 10 wherein the providing of the cartridge further comprises providing a quantity of the ink means adsorbed on the ribbon that is greater than two times a maximum quantity of ink means adsorbable on a single ply of the fabric.

17. The method of claim 10 wherein the providing of the cartridge further comprises providing that the quantity of the ink means adsorbed on the ribbon is at least two and half times the maximum quantity of ink means adsorbable on a single ply of the fabric.

18. The method of claim 10 wherein the providing of the cartridge further comprises providing that the ink means comprises oil soluble dyes and no significant particulate.

* * * * *